US011274011B2

(12) United States Patent
Okada et al.

(10) Patent No.: US 11,274,011 B2
(45) Date of Patent: Mar. 15, 2022

(54) SHEET POST-PROCESSING DEVICE AND IMAGE FORMING SYSTEM PROVIDED THEREWITH

(71) Applicant: KYOCERA Document Solutions Inc., Osaka (JP)

(72) Inventors: Rina Okada, Osaka (JP); Masahiko Miyazaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/016,276

(22) Filed: Sep. 9, 2020

(65) Prior Publication Data

US 2021/0070580 A1 Mar. 11, 2021

(30) Foreign Application Priority Data

Sep. 11, 2019 (JP) ..... JP2019-165492

(51) Int. Cl.
*B65H 37/04* (2006.01)
*B65H 31/34* (2006.01)
*B31F 5/00* (2006.01)

(52) U.S. Cl.
CPC ..... *B65H 37/04* (2013.01); *B31F 5/001* (2013.01); *B65H 31/34* (2013.01)

(58) Field of Classification Search
CPC .... B31F 5/001; B31F 5/02; B31F 2201/0774; B31F 2201/0754; B31F 2201/0707; B65H 31/34; B65H 37/04; B65H 2301/43828; B65H 2301/51616; B65H 2301/51611
USPC ..... 270/58.07, 58.08, 58.12
See application file for complete search history.

(56) References Cited

U.S. PATENT DOCUMENTS 5,384,634 A * 1/1995 Takehara ..... B42C 1/125 270/58.12
5,634,632 A * 6/1997 Furuya ..... B42C 1/125 270/58.12
5,997,239 A * 12/1999 Mimura ..... B65H 31/3081 270/58.11
8,246,033 B2 * 8/2012 Sato ..... B65H 37/04 270/58.09
8,596,633 B2 * 12/2013 Awaya ..... B65H 37/04 270/58.08
9,259,894 B2 * 2/2016 Abe ..... B42B 5/00
2011/0233844 A1 9/2011 Shiraishi et al. ..... 270/58.11

FOREIGN PATENT DOCUMENTS

JP 2011-207560 A 10/2011

* cited by examiner

*Primary Examiner* — Leslie A Nicholson, III
(74) *Attorney, Agent, or Firm* — Stein IP, LLC

(57) ABSTRACT

A sheet post processing device includes a loading tray on which a sheet conveyed thereto is loaded, a side end edge binding stapler fixed at a position opposed to a side end edge, along a conveyance direction, of a sheet bundle of a plurality of sheets loaded on the loading tray, the side end edge binding stapler performing a first binding process on the side end edge, a conveyance unit that moves the sheet bundle on the loading tray in the conveyance direction, and a controller that controls the conveyance unit. The controller can cause the conveyance unit to move the sheet bundle in the conveyance direction so as to perform the first binding process on the sheet bundle with the side end edge binding stapler at a plurality of positions along the side end edge.

9 Claims, 6 Drawing Sheets

SHEET POST-PROCESSING DEVICE AND IMAGE FORMING SYSTEM PROVIDED THEREWITH

INCORPORATION BY REFERENCE

This application is based upon and claims the benefit of priority from the corresponding Japanese Patent Application No. 2019-165492 filed on Sep. 11, 2019, the entire contents of which are incorporated herein by reference.

BACKGROUND

The present disclosure relates to a sheet post-processing device which loads, on a loading tray, sheets, such as paper sheets, each having an image formed thereon by an image forming apparatus such as a copier, a printer, or the like, and performs a binding process with respect to the sheets, and an image forming system provided therewith.

Conventionally, there has been proposed a sheet post-processing device which performs a post-process with respect to a sheet having an image formed thereon by an image forming apparatus. The post-process includes, for example, a punch-hole forming process to form a punch hole (a through hole) in a sheet having undergone image formation and a binding process to stack a plurality of such sheets and bind them as a bundle with a stapler.

In recent years, there have been proposed sheet post-processing devices equipped with both a first stapler which performs a binding process using a staple and a second stapler which performs a binding process without using a staple. For example, the following technology is known. That is, a first stapler is provided to be movable along a sheet bundle loaded on a loading unit by one half of the perimeter of the sheet bundle. A second stapler is provided to be movable along the sheet bundle by the other half of the perimeter. With this configuration, by moving the first stapler, it is possible to perform the binding process with a staple at a plurality of positions along, for example, a rear end edge (an end edge on an upstream side in a conveyance direction toward a discharge tray) of a sheet bundle. Also, by moving the second stapler, it is possible to perform the binding process without a staple at a plurality of positions along, for example, a side end edge (an end edge along the conveyance direction) of a sheet bundle.

SUMMARY

According to one aspect of the present disclosure, a sheet post-processing device includes a loading tray on which a sheet conveyed thereto is loaded, a side end edge binding stapler fixed at a position opposed to a side end edge, along a conveyance direction, of a sheet bundle of a plurality of the sheets loaded on the loading tray, the side end edge binding stapler performing a first binding process on the side end edge, a conveyance unit that moves the sheet bundle on the loading tray in the conveyance direction, and a controller that controls the conveyance unit. The controller can cause the conveyance unit to move the sheet bundle in the conveyance direction so as to perform the first binding process on the sheet bundle with the side end edge binding stapler at a plurality of positions along the side end edge.

Still other objects of the present disclosure and specific advantages provided by the present disclosure will be made further apparent from the following description of an embodiment.

DETAILED DESCRIPTION

For example, in a configuration where a stapler (a second stapler) is moved such that a binding process (for example, a staple-free binding) is performed at a plurality of positions along a side end edge of a sheet bundle, it is necessary to provide a moving mechanism (a rail, a motor, etc.) for the stapler, and it is also necessary to secure a moving space for the stapler. This increases the size of the sheet post-processing device.

The present disclosure provides a sheet post-processing device that is capable of performing a binding process at a plurality of positions along a side end edge of a sheet bundle without moving a stapler therealong, thereby eliminating the need to provide a moving mechanism for the stapler or securing a moving space for the stapler to avoid an increase in size, and an image forming system provided with such a sheet post-processing device.

Image Forming System

Figure 1:
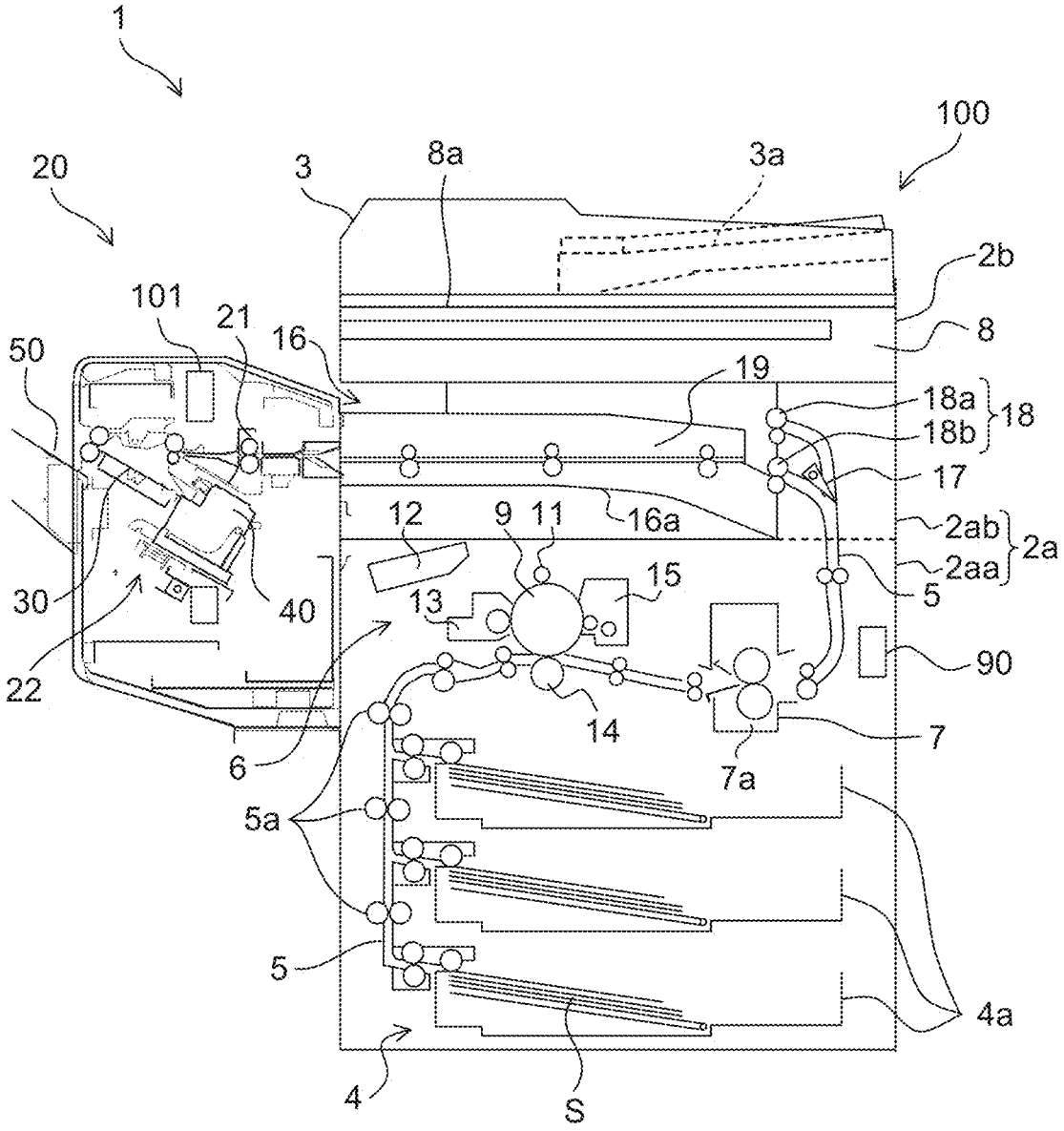
FIG. 1 is a sectional view showing a schematic configuration of an image forming system according to an embodiment of the present disclosure.

Hereinafter, an embodiment of the present disclosure will be described with reference to the accompanying drawings. FIG. 1 is a sectional view showing a schematic configuration of an image forming system 1 according to the embodiment of the present disclosure. The image forming system 1 is constituted by including an image forming apparatus 100 and a sheet post-processing device 20. The image forming apparatus 100 forms an image on a sheet S, such as a paper sheet, and then feeds the sheet S to the sheet post-processing device 20. The image forming apparatus 100 is exemplified by a multifunction peripheral in the embodiment. The image forming apparatus 100 may be an image forming apparatus other than a multifunction peripheral, such as, for example, a laser printer, an inkjet printer, or a facsimile machine.

(Schematic Configuration of Image Forming Apparatus)

The image forming apparatus 100 is what is called an in-body discharge type digital multifunction peripheral, and is broadly composed of a main housing 2*a* and an upper housing 2*b* disposed above the main housing 2*a*. The upper housing 2*b* is provided with later-described various mechanisms for reading a document image as an electric signal. On top of the upper housing 2*b*, a document conveyance device 3 is attached. On the other hand, the main housing 2*a* is provided with later-described various mechanisms for transferring an image onto the sheet S based on the electric signal of the read document image. To a left side part of the main housing 2*a*, the sheet post-processing device 20 is attached.

In the embodiment, the main housing 2*a* is composed of a lower housing 2*aa* and a coupling housing 2*ab*. In the lower housing 2*aa*, there are provided a sheet feeding unit 4 for feeding the sheet S, an image forming unit 6 which forms a toner image on the sheet S, a fixing unit 7 for fixing the toner image on the sheet S, etc. The coupling housing 2*ab* is located, above the lower housing 2*aa*, along a right-side part of the lower housing 2*aa*, and is coupled to the upper housing 2*b*. The coupling housing 2*ab* is provided with a sheet discharge unit (a discharge unit) 18 for conveying the sheet S after fixing to discharge the sheet S from the main housing 2*a*.

On a left side of the coupling housing 2*ab*, directly under the upper housing 2*b*, an in-body discharge space 16 is formed to be widely open toward a left side face and a front face. In the in-body discharge space 16, a relay unit 19 is provided. The relay unit 19 receives the sheet S discharged from a left side face of the coupling housing 2*ab* to have them loaded thereon, and when a predetermined post-process is to be performed with respect to the sheet S, the relay unit 19 conveys the sheet S to the sheet post-processing device 20.

The main housing 2*a* is provided therein with the following units: the sheet feeding unit 4 disposed in a lower part; a sheet conveyance unit 5 disposed to extend beside and above the sheet feeding unit 4, the image forming unit 6 disposed above the sheet feeding unit 4, and the fixing unit 7 disposed on a downstream side (a right side in FIG. 1) of the image forming unit 6 in a sheet conveyance direction.

The sheet feeding unit 4 is provided with a plurality of sheet feeding cassettes 4*a* each having a separating feeding means, such as a sheet feeding roller or the like, provided on a downstream side thereof in the sheet conveyance direction. The sheet feeding roller rotates to feed sheets S one by one to the sheet conveyance unit 5 from the top of a bundle of the sheets S loaded in one of the sheet feeding cassettes 4*a*. The sheet conveyance unit 5 conveys the sheets S fed from the sheet feeding unit 4 to the image forming unit 6 by means of conveyance roller pairs 5*a*.

The image forming unit 6 and the fixing unit 7 are disposed inside the image forming apparatus 100 to extend in a manner elongated along a width direction (a front-rear direction, a direction orthogonal to a surface of the sheet on which FIG. 1 is drawn) which is orthogonal to the sheet conveyance direction. In an upper part inside the lower housing 2*aa*, from a left side in FIG. 1, the image forming unit 6 and the fixing unit 7 are arranged side by side in this order along a direction (a left-to-right direction) in which the sheet S is conveyed.

The image forming unit 6 forms a predetermined toner image on the sheet S through an electro-photographic process. The image forming unit 6 is provided with a photosensitive drum 9 which is an image carrier supported to be rotatable about an axis. The image forming unit 6 is further provided with the following devices arranged around the photosensitive drum 9 in its rotation direction: a charging device 11, an exposure device 12, a development device 13, a transfer device 14, a cleaning device 15, and an unillustrated charge removing device. In the fixing unit 7, the sheet S onto which a toner image has been transferred at the image forming unit 6 is sandwiched between a heat roller and a pressure roller which constitute a fixing roller pair 7*a*, whereby heat and pressure are applied to the sheet S and the non-fixed toner image is fixed onto the sheet S.

The upper housing 2*b* is provided therein with an image reading unit 8, which reads image information of a document. In a case of manually placing documents one by one to be read, the document conveyance device 3 is opened and the documents are placed on a contact glass 8*a* provided at an upper face of the upper housing 2*b*. By contrast, in a case of having a bundle of documents automatically read one by one, the bundle of documents is placed on a sheet feeding tray 3*a* of the document conveyance device 3 in a closed state. In this case, one document after another from the bundle of documents placed on the sheet feeding tray 3*a* are automatically fed onto the contact glass 8*a*. In whichever case, a document located on the contact glass 8*a* is irradiated with light from an unillustrated exposure lamp and reflects the light as image light, which is guided, via an optical system of, for example, a reflection mirror and an imaging lens (of which neither is shown), to a photoelectric conversion unit (a CCD), and thereby image information of the document is obtained.

Hereinafter, a basic operation of the image forming apparatus 100 having the above configuration will be described. First, a circumferential surface of the photosensitive drum 9, which rotates in a counterclockwise direction in FIG. 1, is uniformly charged by the charging device 11. Next, based on image information read by the image reading unit 8, a laser beam from the exposure device 12 (a laser device or the like) is shone onto the circumferential surface of the photosensitive drum 9. Thereby, an electrostatic latent image is formed on the circumferential surface of the photosensitive drum 9. To the electrostatic latent image, toner as a developer is supplied from the development device 13, and thereby a toner image is formed.

Next, the sheet S from the sheet feeding unit 4 passes through the sheet conveyance unit 5 to be conveyed, at a predetermined timing, toward the photosensitive drum 9 having had a toner image formed thereon. Then, by the transfer device 14 constituted by a transfer roller or the like, the toner image on the circumferential surface of the photosensitive drum 9 is transferred onto the sheet S. The sheet S to which the toner image has been transferred is separated from the photosensitive drum 9 to be conveyed toward the fixing device 7. The sheet S is subjected to heating and pressurization process while passing through the fixing roller pair 7*a*, whereby the toner image is fixed onto the sheet S.

After the process of transferring the toner image onto the sheet S is completed, residual toner remaining on the circumferential surface of the photosensitive drum 9 is removed by the cleaning device 15. Next, with respect to the circumferential surface of the photosensitive drum 9, the charge removing device (not shown) performs a charge removing process to remove residual charge. Thereafter, the charging process is performed by the charging device 11 again with respect to the circumferential surface of the photosensitive drum 9, followed by execution of the image formation process in the same way as described above.

The sheet S having passed through the fixing unit 7 is conveyed as it is vertically upward along the sheet conveyance unit 5 into the coupling housing 2*ab*. An upper part of the sheet conveyance unit 5 is branched leftward into upper and lower, two conveyance paths within the coupling housing 2*ab*. The conveyance direction of the sheet S is switched by a switching claw 17 arranged at the branch portion.

The coupling housing 2*ab* is provided therein with a sheet discharge unit 18. The sheet discharge unit 18 has an upper discharge roller pair 18*a* and a lower discharge roller pair 18*b* arranged directly under the upper discharge roller pair 18*a*. The sheet S having been conveyed through the sheet conveyance unit 5 is guided by the switching claw 17 into the upper conveyance path or the lower conveyance path.

When guided by the switching claw 17 into the upper conveyance path, the sheet S is discharged leftward by the upper discharge roller pair 18*a*. By contrast, when guided by the switching claw 17 into the lower conveyance path, the sheet S is discharged leftward by the lower discharge roller pair 18*b*. The switching claw 17 is configured to have its guiding direction switched by a main body controller 90.

The relay unit 19 is attachably and detachably attached to a bottom surface 16*a* of the in-body discharge space 16. In the in-body discharge space 16, a detection sensor (not shown) is provided to detect the attaching of the relay unit 19. The detection sensor is constituted by a PI sensor or the like, and transmits the result of detection to the main body controller 90.

Further, on the bottom surface 16*a*, an inclined surface is formed to be inclined upward toward a downstream side in a sheet discharge direction (the left side in FIG. 1). When the relay unit 19 is detached from the in-body discharge space 16, the bottom surface 16*a* is used as a sheet discharge tray. In this case, the detection sensor detects that the relay unit 19 is not attached, and when the result of detection is transmitted to the main body controller 90, the switching claw 17 guides the sheet S to the upper discharge roller pair 18*a*. Then, the sheet S discharged from the upper discharge roller pair 18*a* is discharged onto the bottom surface 16*a*.

By contrast, when the detection sensor detects that the relay unit 19 is attached to the in-body discharge space 16, and the result of detection is transmitted to the main body controller 90, the switching claw 17 guides the sheet S to the lower discharge roller pair 18*b*. Then, the sheet S discharged from the lower discharge roller pair 18*b* is delivered to the relay unit 19. The sheet S having been delivered to the relay unit 19 passes through inside the relay unit 19, and is delivered to the sheet post-processing device 20.

Here, the result of detection can be displayed on an operation panel (not shown) such that the user can switch, on the operation panel, the direction in which to guide the sheet S. Further, an upper face part of the relay unit 19 may constitute a sheet discharge tray on which the sheet S discharged from the upper discharge roller pair 18*a* is placed.

(Schematic Configuration of Sheet Post-Processing Device)

Next, a description will be given of a configuration of the sheet post-processing device 20. The sheet post-processing device 20 is provided therein a punch-hole forming device 21 and a stapler unit 22. The punch-hole forming device 21 performs punch-hole formation with respect to a sheet S delivered thereto. The stapler unit 22 loads (stacks) a plurality of sheets S delivered thereto, and performs a binding process with respect to the stacked sheets S. The stapler unit 22 includes a loading tray 30, on which a sheet S delivered thereto is loaded, and a stapler 40, which binds a sheet bundle loaded on the loading tray 30. At a side face of the sheet post-processing device 20, there is provided a discharge tray 50 that is movable up and down to a position appropriate for discharging of the sheet S. Various portions of the sheet post-processing device 20 are controlled by a post-processing controller 101. Here, the discharge tray 50 is provided on a downstream side of the loading tray 30 in the conveyance direction.

The punch-hole forming device 21 is arranged in an upper part of the sheet post-processing device 20, and forms a plurality of punch holes in the sheet S along one of side end edges (on the device front or rear side) of the sheet S parallel to the direction in which the sheet S is conveyed, or along a rear end of the sheet S. On an upstream side of the punch-hole forming device 21, substantially at a center part in a direction (a direction perpendicular to a surface of the sheet on which FIG. 1 is drawn) that is orthogonal to the sheet conveyance direction, a delivery detection sensor (not shown) is arranged. The delivery detection sensor detects a leading end of a sheet S delivered to the sheet post-processing device 20 by a sheet delivery roller pair provided in the relay unit 19.

Figure 2:
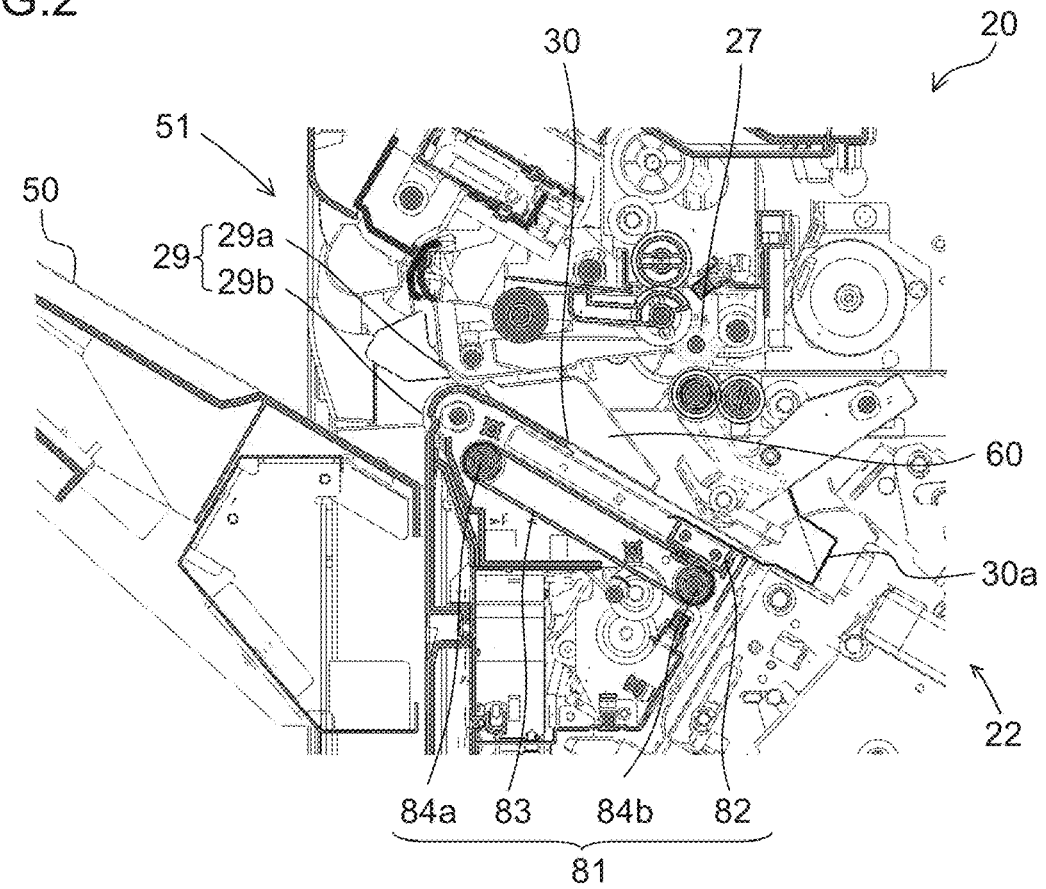
FIG. 2 is a partial sectional view of and around a loading tray inside a sheet post-processing device included in the image forming system.

FIG. 2 is a partial sectional view of and around the loading tray 30 inside the sheet post-processing device 20. In FIG. 2, for convenience, illustration of a later-described second stapler 40*b* (see, for example, FIG. 6) is omitted. On a downstream side of the punch-hole forming device 21 (see FIG. 1) with respect to the sheet conveyance direction, a first discharge roller pair 27 is disposed. On an upstream side of the first discharge roller pair 27, a sheet detection sensor (not shown) of an actuator type is arranged to detect passage of a sheet.

Furthermore, below the first discharge roller pair 27, the following are provided: the above-described loading tray 30 on which a predetermined number of sheets conveyed by the first discharge roller pair 27 are loaded; and the stapler 40 (see FIG. 1) which performs the binding process with respect to a sheet bundle loaded on the loading tray 30.

Further, on the downstream side of the loading tray 30 with respect to the sheet conveyance direction, a second discharge roller pair 29 is disposed. The second discharge roller pair 29 functions as a conveyance unit 85 that conveys a sheet bundle after the binding process performed thereon by the stapler 40 and discharges the sheet bundle via a discharge port 51 onto the discharge tray 50. The second discharge roller pair 29 is composed of a discharge roller 29*a* that is made of rubber and can be rotated by a drive motor (not shown) both in forward and reverse directions, and a discharge skid 29*b* that is made of resin and rotates following the rotation of the discharge roller 29*a*. The discharge roller 29*a* can be shifted by a discharge roller pair gap adjusting mechanism 31 (see FIG. 5) in an up-down direction. The discharge roller pair gap adjusting mechanism 31 is constituted by a roller holder, for example, of which one end is connected to a rotation shaft, and of which the other end rotatably supports the discharge roller 29*a*. By the rotation of the roller holder about the rotation shaft, the discharge roller 29*a* can be shifted in the up-down direction, and thereby, the gap between the discharge roller 29*a* and the discharge skid 29*b* can be adjusted.

Above the loading tray 30, on a downstream side (a left side in FIG. 2) of the first discharge roller pair 27, there is disposed a hitting member (not shown). The hitting member hits a sheet delivered by the first discharge roller pair 27 in a direction toward the loading tray 30 to thereby make the sheet lie flat along a surface of the loading tray 30. The loading tray 30 is provided so as to be inclined downward toward the rear end side (a right side in FIG. 2) of a sheet loaded thereon. Reverse rotation of the second discharge roller pair 29 causes a sheet to be drawn onto the loading tray 30 with its rear end side first, and the rear end of the sheet comes into contact with a butting unit 30*a*. Thereby, a sheet bundle is loaded on the loading tray 30 with its rear end evened up. Accordingly, the butting unit 30*a* functions as a regulation member that regulates a position of a rear end edge $S_R$ (see FIG. 3, FIG. 4) of the sheet bundle to a predetermined position, the rear end edge $S_R$ being located on an upstream side of the sheet bundle with respect to a conveyance direction of the sheet bundle (from the loading tray 30 toward the discharge tray 50) and orthogonal to a side end edge $S_S$. Note that the rear end edge $S_R$ can also be defined as an edge of the sheet bundle that is located on an upstream side in the conveyance direction and extends in a direction perpendicular to the conveyance direction. Further, the side end edge $S_S$ can also be defined as one of opposite side end edges of the sheet bundle that are located opposite each other in the direction perpendicular to the conveyance direction and extend in the conveyance direction.

The sheet post-processing device 20 further includes a butting unit moving mechanism 81 (a regulation member moving mechanism) that moves the butting unit 30*a* in the conveyance direction. The butting unit moving mechanism 81 is constituted by including a support member 82 that supports the butting unit 30*a*, an endless belt 83 to which the support member 82 is fixed, and stretching rollers 84*a* and 84*b* between which the endless belt 83 is wound under tension and which make the endless belt 83 run. One of the stretching rollers 84*a* and 84*b* is a driving roller driven by an unillustrated motor, and the other is a driven roller. The loading tray 30 has formed therein a groove (not shown) in which the support member 82 is slidable in the conveyance direction of the sheet bundle. By the stretching rollers 84*a* and 84*b* making the endless belt 83 run, for example, in a counterclockwise direction in FIG. 2, it is possible, via the support member 82 fixed to the endless belt 83, to move the butting unit 30*a* to a downstream side in the conveyance direction. Thereby, it is possible to move the sheet bundle on the loading tray 30 in the conveyance direction to be discharged onto the discharge tray 50 via the discharge port 51. Thus, it can also be said that the butting unit 30*a* provided as a regulation member also serves to convey the sheet bundle by moving in the conveyance direction.

Figure 3:
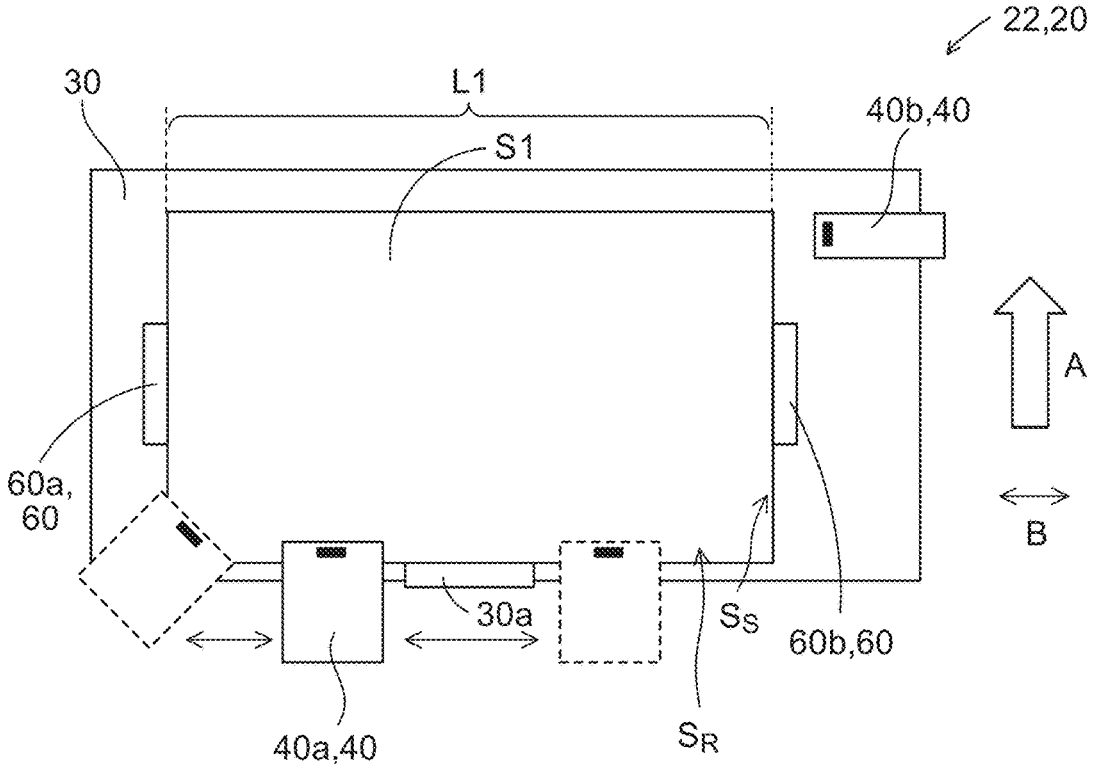
FIG. 3 is a plan view schematically showing a configuration of and around the loading tray in the sheet post-processing device, and also schematically showing positions where alignment members are located when a binding process is performed with respect to a first sheet bundle on the loading tray.

Further, the loading tray 30 is provided with a plurality of alignment members (alignment cursors) 60. The plurality of alignment members 60 align the sheet bundle loaded on the loading tray 30 in a sheet width direction (a direction perpendicular to a surface of the sheet on which FIG. 2 is drawn). FIG. 3 is a plan view schematically showing a configuration of part of the stapler unit 22 around the loading tray 30. Here, for the convenience of description below, the conveyance direction (a discharge direction) in which the second discharge roller pair 29 conveys (discharges) the sheet bundle will be referred to as an A direction, and the sheet width direction perpendicular to the A direction will be referred to as a B direction. Note that the B direction is also a direction along the rear end edge $S_R$ (an end edge on an upstream side in the A direction) of the sheet bundle.

The plurality of alignment members 60 of the stapler unit 22 align the sheet S loaded on the loading tray 30. These alignment members 60 are constituted by a first alignment member 60*a* and a second alignment member 60*b*. The first and second alignment members 60*a* and 60*b* are each formed to be long in the A direction.

The first and second alignment members 60*a* and 60*b* can each be moved (shifted) by an alignment member moving mechanism 61 (see FIG. 5) in the B direction. The alignment member moving mechanism 61 is constituted by including support members respectively supporting the first and second alignment members 60*a* and 60*b*, motors for respectively moving the first and second alignment members 60*a* and 60*b*, etc. With this arrangement, it is possible to move the first alignment member 60*a* and the second alignment member 60*b* in the B direction independently of each other.

The stapler 40 of the stapler unit 22 performs the binding process with respect to a bundle of sheets (a sheet bundle) having been aligned on the loading tray 30 by the plurality of alignment members 60. This stapler 40 is constituted by including a first stapler 40*a* and a second stapler 40*b*. The first stapler 40*a* is a movable binding-type stapler that moves in the B direction to a plurality of positions on the sheet bundle along the rear end edge $S_R$ thereof, and performs a binding process with a staple with respect to the rear end edge $S_R$ of the sheet bundle. Further, the first stapler 40*a* is also a rear end edge binding stapler that is arranged to be opposed to the rear end edge $S_R$ of the sheet bundle and performs the binding process at at least one place in the rear end edge $S_R$.

By contrast, the second stapler 40*b* is arranged at a position different from the position of the first stapler 40*a* in the B direction, and performs a binding process with respect to the side end edge $S_S$ (see FIG. 4) of the sheet bundle along the A direction. More specifically, the second stapler 40*b* is fixed at one side in the B direction, at a position that is outside a moving range of the first stapler 40*a*, to be opposed to the side end edge $S_S$ of the sheet bundle, and performs, with respect to the side end edge $S_S$, a binding process different from the binding process performed by the first stapler 40*a*. The different binding process performed here is a process of binding the sheet bundle without using a staple. Examples of the binding process performed without using a staple include, for example, a process of pressing a sheet bundle with a tooth mold to form a dent and a bump therein to thereby press-bond the loaded sheets to each other, a process of forming a cut in a sheet bundle in its thickness direction and folding part of the sheet bundle along the cut to thereby bind the sheet bundle, etc. In particular, in the embodiment, the second stapler 40*b* is a fixed binding stapler arranged to be opposed to a position for performing the binding process, with respect to the side end edge $S_S$ of the sheet bundle loaded on the loading tray 30, before being conveyed by the second discharge roller pair 29 in the A direction, on the downstream-side end part $S_{S1}$ (see FIG. 4) of the side end edge $S_S$.

Hereinafter, a sheet bundle with respect to which a binding process is performed by the first stapler 40*a* will be referred to also as a first sheet bundle S1. A sheet bundle with respect to which a binding process is performed by the second stapler 40*b* will be referred to also as a second sheet bundle S2. The second sheet bundle S2 with respect to which the second stapler 40*b* can perform the binding process has a smaller thickness than the first sheet bundle S1 with respect to which the first stapler 40*a* can perform the binding process. That is, assuming that each sheet S in the first and second sheet bundles S1 and S2 has an equal thickness, the maximum number of sheets in the sheet bundle S2 with respect to which the second stapler 40*b* can perform the binding process is smaller than the maximum number of sheets in the sheet bundle S1 with respect to which the first stapler 40*a* can perform the binding process. Thus, a mouth opening of the second stapler 40*b* into which the second sheet bundle S2 is inserted is configured to have a smaller width in the up-down direction (a direction perpendicular to directions A and B) than that of the first stapler 40*a* into which the first sheet bundle S1 is inserted.

Figure 4:
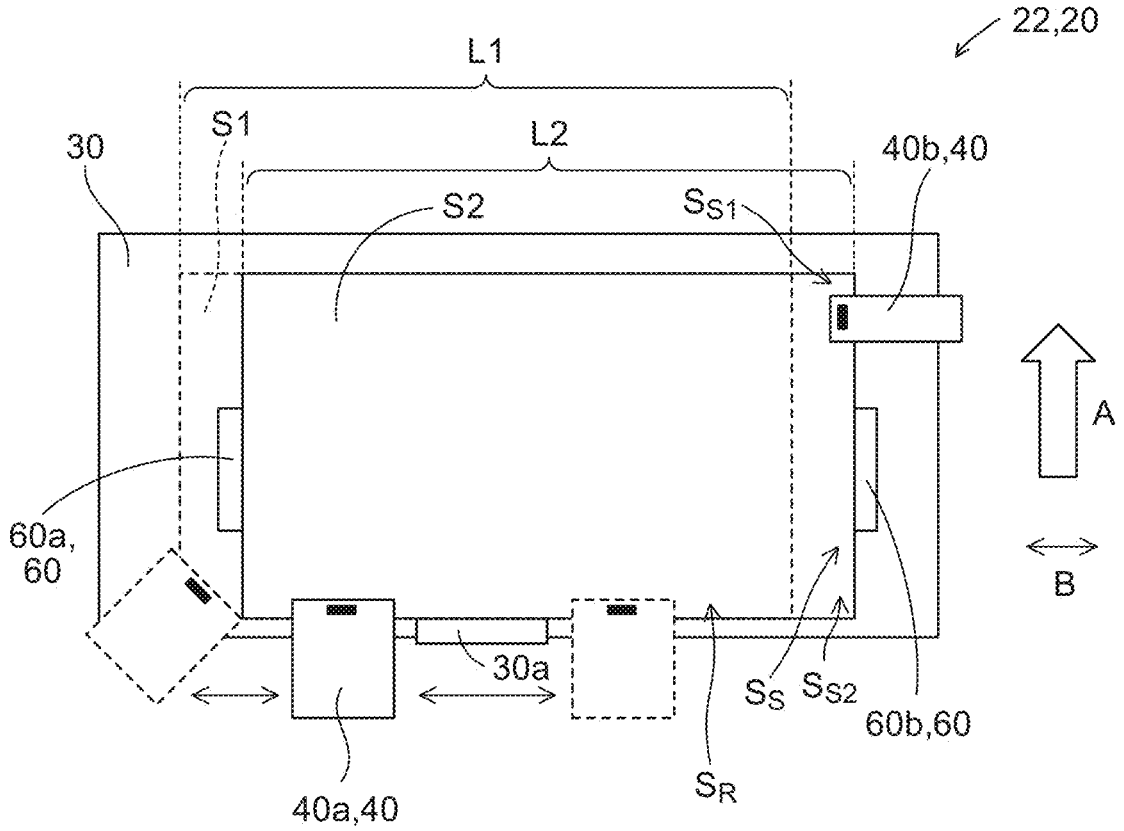
FIG. 4 is a plan view schematically showing the configuration of and around the loading tray in the sheet post-processing device, and also schematically showing positions of the alignment members when the binding process is performed with respect to a second sheet bundle on the loading tray.

Accordingly, as shown in FIG. 3, the second stapler 40*b* is located not to interfere with the first sheet bundle S1 which is to be bound by the first stapler 40*a*, that is, the second stapler 40*b* is located at a position outside the first sheet bundle S1 in the B direction. Thus, as shown in FIG. 4, a first loading position L1 (a second position) and a second loading position L2 (a first position) are displaced from each other in the B direction. Here, the first loading position L1 refers to a rectangular range in which, when the first stapler 40*a* performs binding (for example, corner binding) on the first sheet bundle S1, the first sheet bundle S1 is loaded on the loading tray 30 by being aligned by the first and second alignment members 60*a* and 60*b*. The second loading position L2 refers to a rectangular range in which, when the second stapler 40*b* performs binding (immediately before performing the binding) on the second sheet bundle S2, the second sheet bundle S2 is loaded on the loading tray 30 by being aligned by the first and second alignment members 60*a* and 60*b*.

The first stapler 40*a* described above is moved by a stapler moving mechanism 45 (see FIG. 5) to a plurality of positions in the B direction. The stapler moving mechanism 45 is constituted by including a rail for moving the first stapler 40*a* along the B direction, a support body supporting the first stapler 40*a*, a motor for moving the support body along the rail in the B direction, etc. By being moved in the B direction by the stapler moving mechanism 45, the first stapler 40*a* can perform the binding process at a plurality of positions on the first sheet bundle S1.

Figure 5:
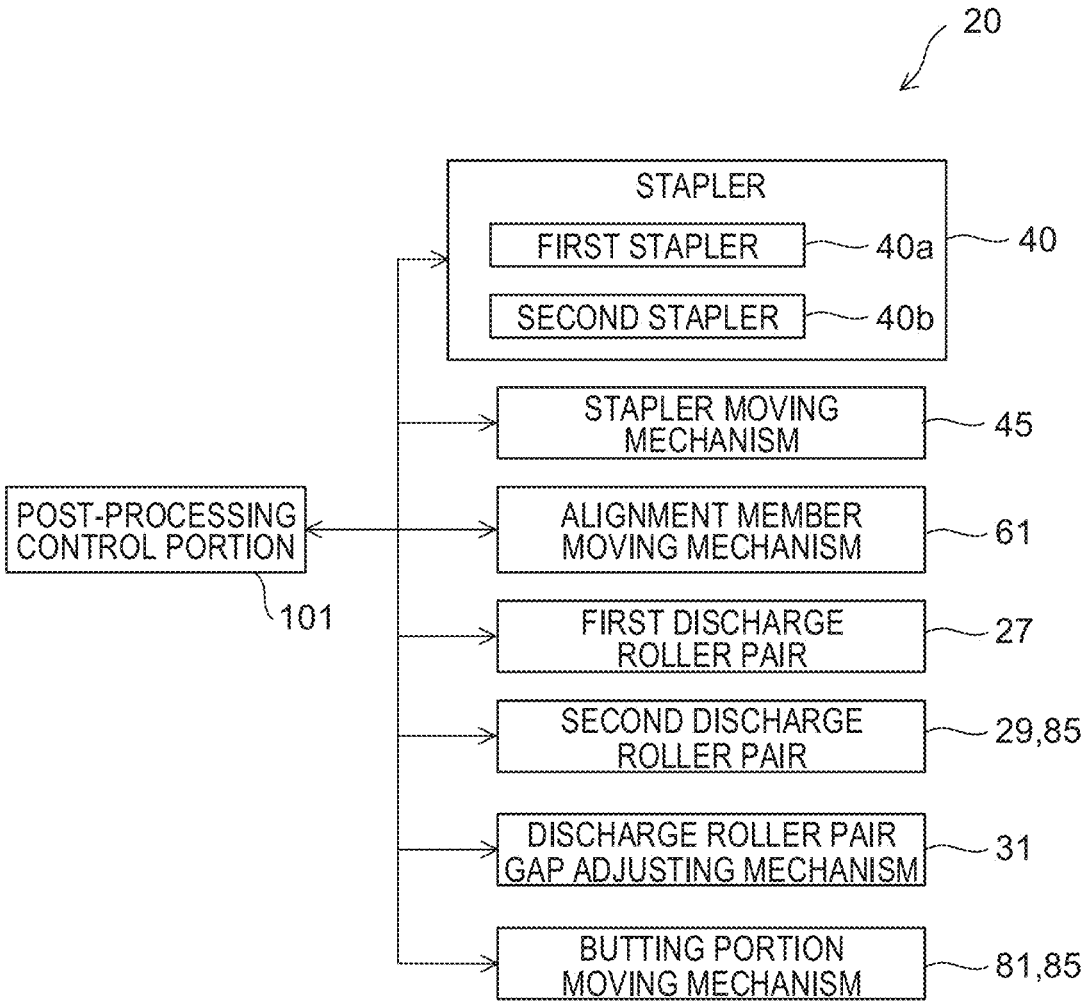
FIG. 5 is a block diagram schematically showing principal portions of the sheet post-processing device.

FIG. 5 is a block diagram schematically showing principal portions of the sheet post-processing device 20 of the embodiment. Operations of the stapler 40 (the first stapler 40*a*, the second stapler 40*b*), the stapler moving mechanism 45, the alignment member moving mechanism 61, the first discharge roller pair 27, the second discharge roller pair 29, the discharge roller pair gap adjusting mechanism 31, and the butting unit moving mechanism 81, of which all have been described above, are controlled by the post-processing controller 101, based on operations performed by the user on the operation panel (not shown) of the image forming apparatus 100. The post-processing controller 101 is a controller constituted by including a central processing device called a CPU (a central processing unit) and storage units such as, for example, a ROM (a read-only memory), a RAM (a random access memory), etc.

The operation panel of the image forming apparatus 100 is constituted by, for example, a liquid crystal display device equipped with a touch panel. By operating the operation panel, the user can input various settings (such as a setting of the number of copies to be made, a setting of whether or not to perform the binding process, etc.). When inputting on the operation panel the setting of whether or not to perform the binding process, the user can also select the first stapler 40*a* or the second stapler 40*b* as the stapler 40 to perform the binding process, and set a binding position for the stapler 40 (a corner, the rear end edge, or the side end edge).

(Operation of Sheet Post-Processing Device)

Next, with reference to FIG. 1 to FIG. 7, a description will be given of an operation of the above-described sheet post-processing device 20. Upon delivery of a sheet having been subjected to an image forming process in the image forming apparatus 100 to the sheet post-processing device 20, in a case where it has been instructed via the operation panel to perform punch-hole formation, the punch-hole forming device 21 forms a punch hole at a predetermined position on the sheet conveyed (for example, at each of two positions on the sheet along a side end edge thereof on the device front side). In a case where it has not been instructed to perform punch-hole formation, the above-described sheet passes through the punch-hole forming device 21 without being subjected to punch-hole formation.

Then, the sheet is conveyed further to a downstream side by the first discharge roller pair 27. At this time, by the discharge roller pair gap adjusting mechanism 31, the discharge roller 29*a* is arranged at a position (a retracted position) separated upward from the discharge skid 29*b*. Thus, the sheet which has been conveyed by the first discharge roller pair 27 passes through a gap between the discharge roller 29*a* and the discharge skid 29*b* to protrude from the second discharge roller pair 29 toward the discharge tray 50.

At timing when a rear end of the sheet has passed through the first discharge roller pair 27, by the discharge roller pair gap adjusting mechanism 31, the discharge roller 29*a* is moved downward so as to hold the sheet between itself and the discharge skid 29*b*. After that, the hitting member is driven to make the sheet lie flat along the loading tray 30. In this state, the discharge roller 29*a* is made to rotate in the reverse direction, thus drawing in the sheet along the loading tray 30, and the rear end of the sheet is aligned by the butting unit 30*a*.

Meanwhile, by the alignment member moving mechanism 61, the first alignment member 60*a* and the second alignment member 60*b* are located on outer sides of the first loading position L1 in the B direction, respectively. Every time a sheet is loaded at the first loading position L1 on the loading tray 30, the alignment member moving mechanism 61 repeatedly performs an alignment operation in which the first alignment member 60*a* and the second alignment member 60*b* are made to move (approach each other) in the B direction so as to align the sheet.

Upon completion of loading a sheet conveyed from the image forming apparatus 100 on the loading tray 30, in a case where it has been designated to perform the binding process with the first stapler 40*a*, with respect to the first sheet bundle S1 which has been loaded on and aligned at the first loading position L1, the first stapler 40*a* is moved to a desired position to perform the binding process. After that, the first sheet bundle S1 is discharged onto the discharge tray 50 by the second discharge roller pair 29. In a case where the first sheet bundle S1 includes a large number of sheets, the first sheet bundle S1 after being subjected to the binding process may be discharged by making the butting unit 30*a* move in the A direction. Furthermore, the first sheet bundle S1 may be discharged by making the second discharge roller pair 29 rotate while making the butting unit 30*a* move as described above.

By contrast, in a case where it has been designated to perform the binding process with the second stapler 40*b*, the alignment member moving mechanism 61 moves the first alignment member 60*a* and the second alignment member 60*b* to one side in the B direction to move a sheet bundle loaded at the first loading position L1 to the second loading position L2 (see FIG. 4). Then, the post-processing controller 101 controls the second discharge roller pair 29 so that the binding process by the second stapler 40*b* is performed with respect to a plurality of positions along the side end edge $S_S$ of the sheet bundle (the second sheet bundle S2) at the second loading position L2. The following describes this in more detail.

Figure 6:
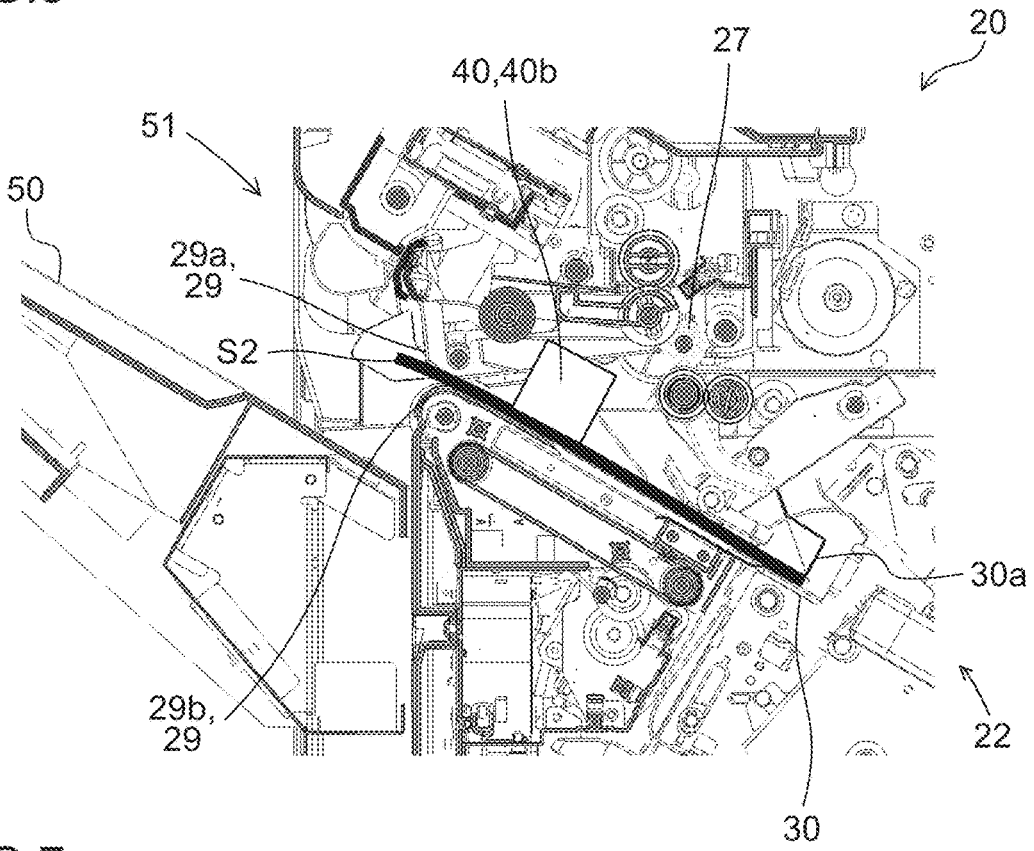
FIG. 6 is a sectional view of the sheet post-processing device before the second sheet bundle is conveyed by a second discharge roller pair.
Figure 7:
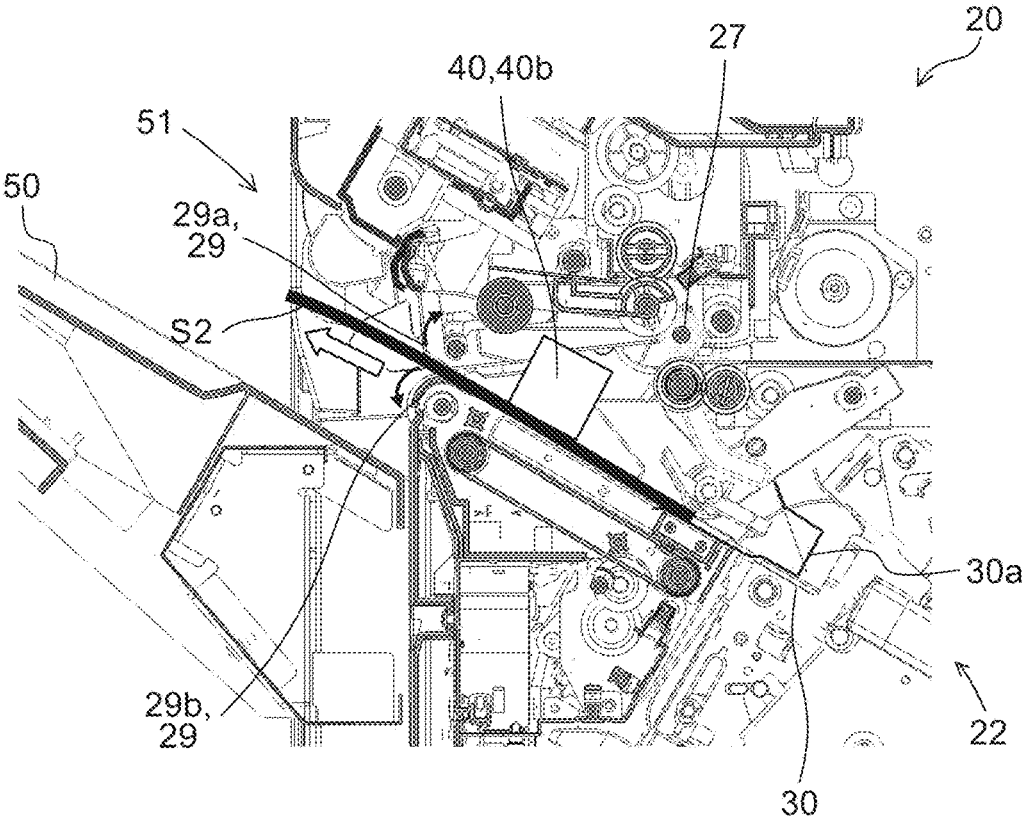
FIG. 7 is a sectional view of the sheet post-processing device at a time when the second sheet bundle is conveyed by the second discharge roller pair and the binding process is performed.

FIG. 6 and FIG. 7 show sectional views of the sheet post-processing device 20 before and after, respectively, the second sheet bundle S2 is conveyed in the A direction by the second discharge roller pair 29. Under control of the post-processing controller 101, the second discharge roller pair 29 conveys, in the A direction, the second sheet bundle S2 arranged at the second loading position L2 so that a position on the second sheet bundle S2 at which a first performance of the binding process by the second stapler 40*b* is to be performed coincides with a position of the mouth opening of the second stapler 40*b*. Then, the first performance of the binding process by the second stapler 40*b* is performed with respect to the side end edge $S_S$ of the second sheet bundle S2. In a case where the position on the second sheet bundle S2 at which the first performance of the binding process by the second stapler 40*b* is to be performed coincides with the position of the mouth opening of the second stapler 40*b* at a time point when the second sheet bundle S2 is arranged at the second loading position L2, the second discharge roller pair 29 does not convey the second sheet bundle S2 in the A direction, in which state the first performance of the binding process by the second stapler 40*b* is performed with respect to the side end edge $S_S$ of the second sheet bundle S2.

In a case of performing a succeeding (second) performance of the binding process, the second discharge roller pair 29 further conveys the second sheet bundle S2 in the A direction so that a position on the second sheet bundle S2 along the side end edge $S_S$ thereof at which the succeeding performance of the binding process is to be performed coincides with the position of the mouth opening of the second stapler 40*b*. Then, the second performance of the binding process by the second stapler 40*b* is performed with respect to the side end edge $S_S$ of the second sheet bundle S2. From then on, until the number of performances of the binding process reaches a predetermined number, in a similar manner to the above, the second discharge roller pair 29 conveys the second sheet bundle S2 in the A direction, and then the binding process by the second stapler 40*b* is performed.

Upon the end of the binding process with respect to the side end edge $S_S$ of the second sheet bundle S2 performed at a plurality of positions therealong, the second discharge roller pair 29 is made to rotate and/or the butting unit 30*a* is moved in the A direction, and thereby the second sheet bundle S2 after being subjected to the binding process is discharged onto the discharge tray 50.

As described above, in a case where, by the second stapler 40*b*, the binding process is performed at a plurality of positions on the second sheet bundle S2 along the side end edge $S_S$ thereof, the post-processing controller 101 makes the conveyance unit 85 convey the second sheet bundle S2 in the A direction to thereby shift a position at which the binding process is performed on the second sheet bundle S2 by the second stapler 40*b*. In this manner, without the need to move the second stapler 40*b* in the A direction, the binding process by the second stapler 40*b* can be performed at a plurality of positions on the second sheet bundle S2 along the side end edge $S_S$ thereof. Accordingly, in achieving the binding process at a plurality of positions on the second sheet bundle S2 along the side end edge $S_S$ thereof, it is no longer needed to provide a moving mechanism for the second stapler 40*b* or secure a moving space for the second stapler 40*b*. As a result, it is possible to avoid an increase in size of the sheet post-processing device 20 resulting from, for example, providing the moving mechanism for the second stapler 40*b*.

Furthermore, the conveyance unit 85 includes the second discharge roller pair 29 which discharges the second sheet bundle S2 toward the discharge tray 50. The second discharge roller pair 29 is an existing constituent component provided in the sheet post-processing device 20 as a roller pair for discharging a sheet bundle (the first sheet bundle S1, the second sheet bundle S2) on the loading tray 30 toward the discharge tray 50. The second discharge roller pair 29 thus configured is used as the conveyance unit 85 which conveys the second sheet bundle S2 for the binding process by the second stapler 40*b* performed at a plurality of positions on the second sheet bundle S2 along the side end edge $S_S$ thereof, and thus it is possible to make effective use of the existing constituent component to achieve the binding process with respect to the side end edge $S_S$ at a plurality of positions therealong.

Furthermore, the second stapler 40*b* is arranged at a position for performing the binding process, with respect to the side end edge $S_S$ of the second sheet bundle S2 loaded on the loading tray 30 before being conveyed by the conveyance unit 85 (the second discharge roller pair 29), on the downstream-side end part $S_{S1}$ in the A direction. That is, the second stapler 40*b*, which is a side end edge binding stapler, is arranged to be opposed to the position for performing the binding process, with respect to the side end edge $S_S$ of the second sheet S2 aligned at the first position (the second loading position L2) on the loading tray 30 by the alignment members 60 (the first and second alignment members 60*a* and 60*b*), on the downstream-side end part $S_{S1}$ in the conveyance direction. In this case, the conveyance of the second sheet bundle S2 by the second discharge roller pair 29 in the A direction makes it possible for the second stapler 40*b* to perform the binding process at a plurality of positions along the side end edge $S_S$ of the second sheet bundle S2, starting from the downstream-side end part $S_{S1}$ until the upstream-side end part $S_{S2}$ (see FIG. 4). Accordingly, it is possible to reliably achieve the binding process at a plurality of positions on the second sheet bundle S2 along the side end edge $S_S$ thereof.

Furthermore, the second stapler 40*b* performs a staple-free binding process which is a binding process different from a staple binding process performed by the first stapler 40*a*. That is, the sheet post-processing device 20 according to the embodiment further includes the first stapler 40*a* as the rear end edge binding stapler which is arranged to be opposed to a position for performing the binding process, with respect to the first sheet bundle S1 aligned at the second position (the first loading position L1) different from the first position (the second loading position L2) on the loading tray 30 by the alignment members 60 (the first alignment member 60*a*, the second alignment member 60*b*), on the rear end edge $S_R$ of the first sheet bundle S1 which is on the upstream side in the conveyance direction of conveyance by the conveyance unit 85 and is orthogonal to the side end edge $S_S$ of the first sheet bundle S1 along the conveyance direction, the rear end edge binding stapler performing the binding process at least at one position on the first sheet bundle S1 along the rear end edge $S_R$ thereof. Further, the second stapler 40*b* as the side end edge binding stapler performs a binding process that is different from the binding process that the first stapler 40*a* performs as the rear end edge binding stapler. In this configuration including both of the two staplers 40 (the first stapler 40*a*, the second stapler 40*b*) which perform mutually different binding processes, the binding process by the second stapler 40*b* is performed at a plurality of positions on the second sheet bundle S2 along the side end edge $S_S$ thereof, and thus the above-described advantage of the embodiment can be obtained.

In particular, the binding process performed by the first stapler 40*a* is the staple binding process, and the binding process performed by the second stapler 40*b* is the staple-free binding process. That is, the second stapler 40*b* as the side end edge binding stapler is a staple-free stapler without using a staple. The first stapler 40*a* as the rear end edge binding stapler, on the other hand, is a stapler that binds with a staple. This configuration reliably provides the sheet post-processing device 20 including both of the two types of staplers 40 which perform mutually different binding processes. Furthermore, in a case where the staple-free binding process by the second stapler 40*b* is performed at a plurality of positions on the second sheet bundle S2 along the side end edge $S_S$ thereof, the above-described advantage of the embodiment can be obtained.

The second stapler 40*b* is not limited to a stapler that performs the staple-free binding process as in the embodiment. For example, the second stapler 40*b* may have a configuration in which, with respect to a sheet bundle, the binding process is performed using a staple different in type (such as a depth of the staple, a width of the staple, a thickness of the staple, or a material of the staple) from the staple used in the first stapler 40*a*.

Furthermore, the first stapler 40*a* is the rear end edge binding stapler which is arranged to be opposed to a position for performing the binding process, with respect to the first sheet bundle S1, which is another sheet bundle, aligned at the loading position L1 different from the loading position L2 for the second sheet bundle S2 on the loading tray 30 by the alignment members 60 (the first alignment member 60*a*, the second alignment member 60*b*), on the rear end edge $S_R$ of the first sheet bundle S1 which is on the upstream side in the conveyance direction of conveyance by the conveyance unit 85 and is orthogonal to the side end edge $S_S$ of the first sheet bundle S1 along the conveyance direction, the rear end edge binding stapler perforating the binding process at least at one position on the first sheet bundle S1 along the rear end edge $S_R$ thereof. The use of the first stapler 40*a* thus configured makes it possible to reliably achieve the binding process with respect to the rear end edge $S_R$ of the first sheet bundle S1.

A plurality of first staplers 40*a* may be fixed at positions opposed to the rear end edge $S_R$ of the first sheet bundle S1 loaded on the loading tray 30 (a fixed type). Further, any of the plurality of first staplers 40*a* may be selectively used to perform the binding process at least at one position on the first sheet bundle S1 along the rear end edge $S_R$ thereof. In a configuration, however, in which, as in the embodiment, the first stapler 40*a* is moved to a plurality of positions on the first sheet bundle S1 along the rear end edge $S_R$ thereof so as to perform the binding process at the plurality of positions (a movable type), the number of rear end edge binding staplers used is one, which is less than that in the fixed type, and thus the movable type is more advantageous also from the viewpoint of cost. That is, cost-wise, it is desirable that the first stapler 40*a* as the rear end edge binding stapler be a movable binding-type stapler which moves to a plurality of positions on a sheet bundle along the rear end edge $S_R$ thereof so as to perform the binding process at the plurality of positions.

(Other Configurations of Conveyance Unit)

The conveyance unit 85 which conveys the second sheet bundle S2 on the loading tray 30 in the A direction along the side end edge $S_S$ of the second sheet bundle S2 may be configured to include the above-described butting unit 30*a* and the butting unit moving mechanism 81. Also in this case, the post-processing controller 101 controls the butting unit moving mechanism 81 so that the binding process can be performed at a plurality of positions on the second sheet bundle S2 along the side end edge $S_S$ thereof. The following describes this in more detail.

Figure 8:
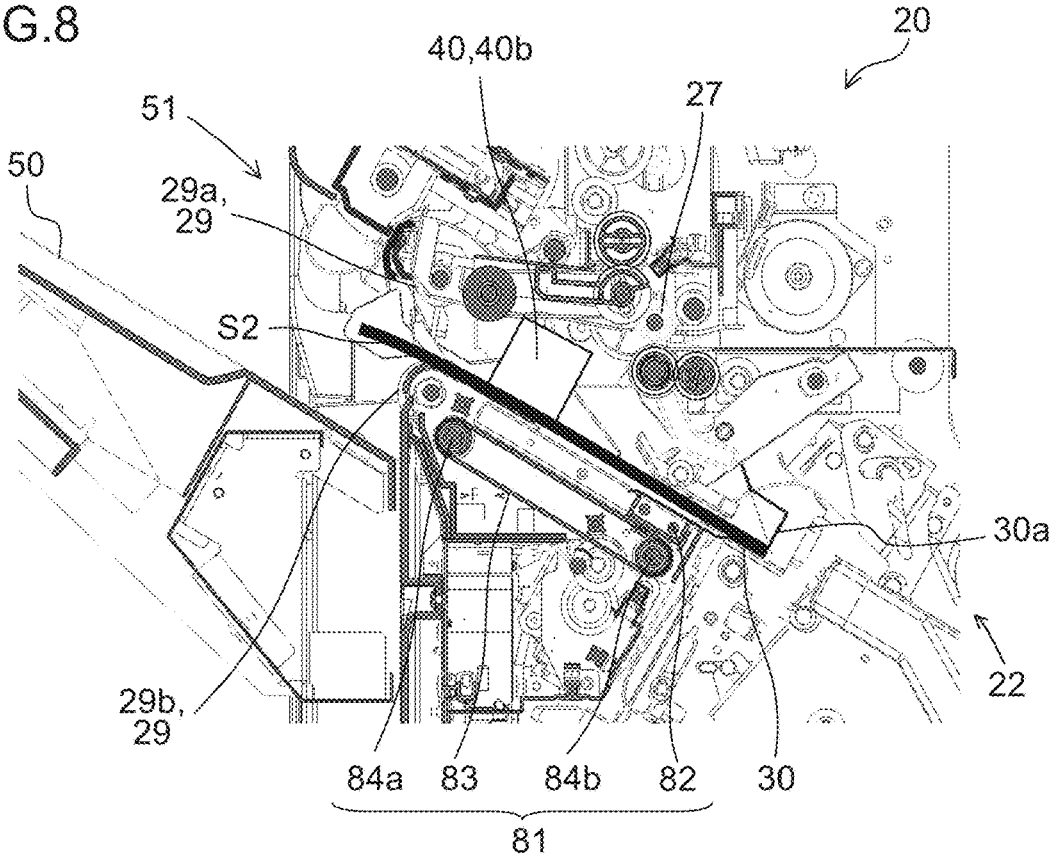
FIG. 8 is a sectional view of the sheet post-processing device before the second sheet bundle is conveyed by a butting unit and a butting unit moving mechanism.
Figure 9:
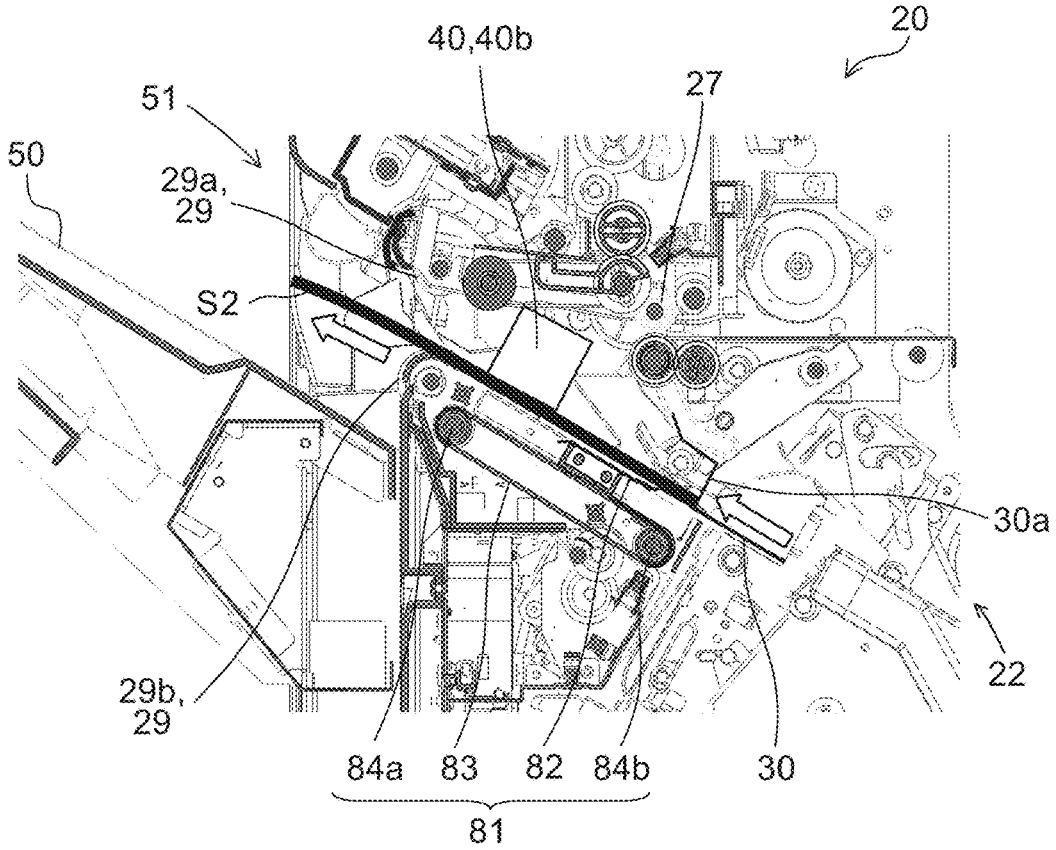
FIG. 9 is a sectional view of the sheet post-processing device at a time when the second sheet bundle is conveyed by the butting unit and the butting unit moving mechanism and the binding process is performed.

FIG. 8 and FIG. 9 show sectional views of the sheet post-processing device 20 before and after, respectively, the second sheet bundle S2 is conveyed in the A direction by the butting unit 30*a* and the butting unit moving mechanism 81. As shown in FIG. 8, the butting unit 30*a* is moved in the A direction by the butting unit moving mechanism 81, and thus the second sheet bundle S2 arranged at the second loading position L2, with a rear end thereof aligned (regulated) by the butting unit 30*a*, is conveyed in the A direction so that a position on the second sheet bundle S2 at which a first performance of the binding process by the second stapler 40*b* is to be performed coincides with a position of the mouth opening of the second stapler 40*b* (see FIG. 9). Then, the first performance of the binding process by the second stapler 40*b* is performed with respect to the side end edge $S_S$ of the second sheet bundle S2. In a case where the position on the second sheet bundle S2 at which the first performance of the binding process by the second stapler 40*b* is to be performed coincides with the position of the mouth opening of the second stapler 40*b* at a time point when the second sheet bundle S2 is arranged at the second loading position L2, the butting unit moving mechanism 81 does not make the buffing unit 30*a* move (does not convey the second sheet bundle S2 in the A direction), in which state the first performance of the binding process by the second stapler 40*b* is performed with respect to the side end edge $S_S$ of the second sheet bundle S2.

In a case of performing a succeeding (second) binding process, the butting unit moving mechanism 81 moves the butting unit 30*a* in the A direction so that a position on the second sheet bundle S2 along the side end edge $S_S$ thereof at which the succeeding binding process is to be performed coincides with the position of the mouth opening of the second stapler 40*b*, thus further conveying the second sheet bundle S2 in the A direction. Then, a second performance of the binding process by the second stapler 40*b* is performed with respect to the side end edge $S_S$ of the second sheet bundle S2. From then on, until the number of performances of the binding process reaches a predetermined number, in a similar manner to the above, the butting unit moving mechanism 81 moves the butting unit 30*a* in the A direction, thus conveying the second sheet bundle S2 in the A direction, and then the binding process by the second stapler 40*b* is performed.

Upon the end of the binding process with respect to the side end edge $S_S$ of the second sheet bundle S2 performed at a plurality of positions therealong, the second discharge roller pair 29 is to rotate and/or the butting unit 30*a* is moved in the A direction, and thus the second sheet bundle S2 after being subjected to the binding process is discharged onto the discharge tray 50.

The above-described butting unit 30*a* is an existing constituent component which is provided in the sheet post-processing device 20 as a member that regulates a position of the rear end edge $S_R$ of a sheet bundle on the loading tray 30 on the upstream side in the A direction (see, for example, FIG. 3). Furthermore, the butting unit moving mechanism 81 also is of an existing configuration in which the butting unit 30*a* is moved so as to discharge a sheet bundle after being subjected to the binding process onto the discharge tray 50. The butting unit 30*a* and the butting unit moving mechanism 81 which have such existing configurations, respectively, are used as the conveyance unit 85 that conveys the second sheet bundle S2 for the binding process by the second stapler 40*b* performed at a plurality of positions on the second sheet bundle S2 along the side end edge $S_S$ thereof, and thus it is possible to make effective use of the existing component and mechanism to achieve the binding process at a plurality of positions on the second sheet bundle S2 along the side end edge $S_S$ thereof.

Furthermore, also in the configuration in which the butting unit 30*a* and the butting unit moving mechanism 81 are used as the conveyance unit 85, the second stapler 40*b* is arranged to be opposed to a position for performing the binding process on the downstream-side end part $S_{S1}$ of the second sheet bundle S2. More specifically, the second stapler 40*b* is arranged to be opposed to the position for performing the binding process, with respect to the side end edge $S_S$ of the second sheet bundle S2 which is loaded on the loading tray 30 and has had the position of the rear end edge $S_R$ thereof regulated by the butting unit 30*a* at the second loading position L2 (the first position), on the downstream-side end part $S_{S1}$ in the A direction. With the second stapler 40*b* arranged in this manner, the second sheet bundle S2 is conveyed in the A direction by the butting unit 30*a*, and thus the binding process can be performed at a plurality of positions on the second sheet bundle S2 along the side end edge $S_S$ thereof.

As discussed above, in the embodiment, in a case of performing the binding process by the stapler at a plurality of positions on a sheet bundle along a side end edge thereof, under control by the controller, the conveyance unit conveys the sheet bundle to thereby shift the position at which the binding process is performed on the sheet bundle in the conveyance direction. Thus, without the need to move the stapler in a direction along the side end edge, the binding process by the stapler can be performed at a plurality of positions on the sheet bundle along the side end edge thereof. Accordingly, in performing the binding process at a plurality of positions on a sheet bundle along a side end edge thereof, it is no longer needed to provide a moving mechanism for the stapler or secure a moving space for the stapler. As a result, it is possible to avoid an increase in size of the sheet post-processing device resulting from, for example, providing the moving mechanism for the stapler.

From the above discussion, it is clear that the controller is capable of making the conveyance unit move a sheet bundle in the conveyance direction to thereby shift a position at which the binding process is performed on the sheet bundle by the side end edge binding stapler such that the binding process is performed with respect to a plurality of positions on the sheet bundle along a side end edge thereof.

While the foregoing has described the embodiment of the present disclosure, the scope of the present disclosure is not limited thereto. The present disclosure can be implemented by adding various modifications thereto without departing from the spirit of the disclosure.

The present disclosure is usable for an image forming system which loads therein a bundle of sheets supplied from an image forming apparatus and performs a binding process with respect to the sheet bundle.

What is claimed is:

1. A sheet post-processing device comprising:

a loading tray on which a sheet conveyed thereto is loaded, a side end edge binding stapler fixed at a position opposed to a side end edge, along a conveyance direction, of a sheet bundle of a plurality of the sheets loaded on the loading tray, the side end edge binding stapler performing a first binding process on the side end edge;

a conveyance unit that moves the sheet bundle on the loading tray in the conveyance direction;

a controller that controls the conveyance unit; and a discharge tray provided on a downstream side of the loading tray in the conveyance direction; and an alignment member that aligns the sheet bundle loaded on the loading tray; and wherein the controller can cause the conveyance unit to move the sheet bundle in the conveyance direction relative to the side end edge binding stapler fixed at the position opposed to the side end edge so as to perform the first binding process on the sheet bundle with the side end edge binding stapler at a plurality of positions along the side end edge, and the conveyance unit includes a discharge roller pair that discharges the sheet bundle toward the discharge tray, and the side end edge binding stapler is arranged to be opposed to a position for performing the first binding process, with respect to the side end edge of the sheet bundle aligned at a first position on the loading tray by the alignment member, on a downstream-side end part in the conveyance direction, and the sheet post-processing device further comprising a rear end edge binding stapler that is arranged to be opposed to a position for performing a second binding process, with respect to the sheet bundle aligned at a second position different from the first position on the loading tray in a sheet width direction orthogonal to the conveyance direction by the alignment member, on a rear end edge that is on an upstream side in the conveyance direction that is orthogonal to the side end edge, the rear end edge binding stapler performing the second binding process on the sheet bundle at least at one position along the rear end edge, wherein the first binding process is different from the second binding process.

2. The sheet post-processing device according to claim 1, wherein the side end edge binding stapler is a staple-free stapler without using a staple, and the rear end edge binding stapler is a stapler that binds with a staple.

3. The sheet post-processing device according to claim 1, wherein the rear end edge binding stapler is a movable binding-type stapler that moves to a plurality of positions along the rear end edge to perform the second binding process.

4. The sheet post-processing device according to claim 1, wherein the conveyance unit includes a regulation member that regulates a position of a rear end edge of the sheet bundle to a predetermined position, the rear end edge being on an upstream side of the sheet bundle in the conveyance direction and orthogonal to the side end edge, and that conveys the sheet bundle by moving in the conveyance direction, and a regulation member moving mechanism that moves the regulation member in the conveyance direction.

5. The sheet post-processing device according to claim 4, further comprising an alignment member that aligns the side end edge of the sheet bundle at a first position on the loading tray, wherein the side end edge binding stapler is arranged so as to be opposed to a downstream end, in the conveyance direction, of the side end edge of the sheet bundle aligned at the first position by the alignment member.

6. The sheet post-processing device according to claim 5, further comprising a rear end edge binding stapler that is arranged to be opposed to a rear end edge of the sheet bundle aligned at a second position different from the first position on the loading tray by the alignment member, the rear end edge being on an upstream side in the conveyance direction and orthogonal to the side end edge, the rear end edge binding stapler performing a second binding process on the sheet bundle at least at one position along the rear end edge, wherein the first binding process is different from the second binding process.

7. The sheet post-processing device according to claim 6, wherein the side end edge binding stapler is a staple-free stapler without using a staple, and the rear end edge binding stapler is a stapler that binds with a staple.

8. The sheet post-processing device according to claim 6, wherein the rear end edge binding stapler is a movable binding-type stapler that moves to a plurality of positions along the rear end edge to perform the second binding process.

9. An image forming system comprising:

the sheet post-processing device according to claim 1; and an image forming apparatus that forms an image on the sheet and feeds the sheet to the sheet post-processing device.

* * * * *